US008616827B2

(12) United States Patent
O'Leary

(10) Patent No.: US 8,616,827 B2
(45) Date of Patent: Dec. 31, 2013

(54) TURBINE BLADE TIP CLEARANCE SYSTEM

(75) Inventor: Mark O'Leary, Zionsville, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 1456 days.

(21) Appl. No.: 12/034,408

(22) Filed: Feb. 20, 2008

(65) Prior Publication Data

US 2009/0208321 A1 Aug. 20, 2009

(51) Int. Cl.
*F01D 11/24* (2006.01)

(52) U.S. Cl.
USPC ..... 415/1; 415/173.2

(58) Field of Classification Search
USPC ..... 415/173.2, 174.1, 177, 178, 180, 173.1, 415/170.1, 134, 135; 416/174
See application file for complete search history.

(56) References Cited

U.S. PATENT DOCUMENTS 3,039,737 A * 6/1962 Kolthoff, Jr. ..... 415/17
4,069,662 A 1/1978 Redinger, Jr. et al.
4,117,669 A * 10/1978 Heller ..... 60/786
4,230,436 A 10/1980 Davison
4,296,599 A * 10/1981 Adamson ..... 60/39.23
4,358,926 A 11/1982 Smith
4,487,016 A 12/1984 Schwarz et al.
4,513,567 A 4/1985 Deveau et al.
4,632,635 A 12/1986 Thoman et al.
4,657,479 A 4/1987 Brown et al.
4,683,716 A 8/1987 Wright et al.
4,815,928 A 3/1989 Pineo et al.
4,844,688 A * 7/1989 Clough et al. ..... 415/116
5,018,942 A 5/1991 Ciokajlo et al.
5,035,573 A 7/1991 Tseng et al.
5,048,288 A 9/1991 Bessette et al.
5,049,033 A 9/1991 Corsmeier et al.
5,054,997 A 10/1991 Corsmeier et al.
5,056,988 A 10/1991 Corsmeier et al.
5,064,343 A 11/1991 Mills
5,076,050 A * 12/1991 Schwarz et al. ..... 60/782
5,096,375 A 3/1992 Ciokajlo (Continued)

FOREIGN PATENT DOCUMENTS

DE 4309199 3/1993

OTHER PUBLICATIONS

E. J. Kawecki, Thermal Response Turbine Shroud Study, Jul. 1979, 139 pages, Pratt and Whitney Aircraft Group, West Palm Beach, FL.

*Primary Examiner* — Nathaniel Wiehe
*Assistant Examiner* — Joshua R Beebe
(74) *Attorney, Agent, or Firm* — Krieg DeVault LLP

(57) ABSTRACT

A system for adjusting a clearance between blade tips of a turbine and a shroud assembly encircling the turbine in a turbine engine is disclosed herein. The system includes a first fluid passageway operable to extend from a first source of fluid at a variable pressure to a shroud assembly of a turbine engine. The first fluid passageway directs a first stream of fluid to the shroud assembly. The system also includes a first valve positioned along the first fluid passageway and moveable between open and closed configurations. The first valve is biased to the open configuration and moved to the closed configuration passively and directly by a first predetermined level of pressure of the first stream of fluid. During periods of relatively low power production of the turbine engine, the first valve is in the open configuration and moves to the closed configuration when power production of the turbine engine increases from relatively low power production.

29 Claims, 9 Drawing Sheets

(56) References Cited

U.S. PATENT DOCUMENTS

| | | | | |
|---|---|---|---|---|
| 5,104,287 | A | 4/1992 | Ciokajlo | |
| 5,116,199 | A | 5/1992 | Ciokajlo | |
| 5,127,793 | A | 7/1992 | Walker et al. | |
| 5,212,940 | A | 5/1993 | Glover | |
| 5,228,828 | A | 7/1993 | Damlis et al. | |
| 5,261,228 | A | 11/1993 | Shuba | |
| 5,344,284 | A | 9/1994 | Delvaux et al. | |
| 5,407,320 | A | 4/1995 | Hutchinson | |
| 5,553,999 | A | 9/1996 | Proctor et al. | |
| 5,562,408 | A | 10/1996 | Proctor et al. | |
| 5,593,277 | A | 1/1997 | Proctor et al. | |
| 5,601,402 | A * | 2/1997 | Wakeman et al. | 415/173.2 |
| 5,772,400 | A * | 6/1998 | Pellow | 415/173.1 |
| 5,779,436 | A * | 7/1998 | Glezer et al. | 415/115 |
| 5,871,333 | A | 2/1999 | Halsey | |
| 6,035,929 | A | 3/2000 | Friedel et al. | |
| 6,089,821 | A | 7/2000 | Maguire et al. | |
| 6,116,852 | A | 9/2000 | Pierre et al. | |
| 6,393,331 | B1 | 5/2002 | Chetta et al. | |
| 6,487,491 | B1 | 11/2002 | Karpman et al. | |
| 6,626,635 | B1 * | 9/2003 | Prowse et al. | 415/1 |
| 6,652,227 | B2 | 11/2003 | Fried | |
| 6,722,137 | B2 | 4/2004 | Proctor et al. | |
| 6,814,538 | B2 | 11/2004 | Thompson | |
| 6,877,952 | B2 | 4/2005 | Wilson | |
| 6,910,851 | B2 | 6/2005 | Franconi et al. | |
| 6,925,814 | B2 | 8/2005 | Wilson et al. | |
| 6,935,836 | B2 | 8/2005 | Ress, Jr. et al. | |
| 6,942,445 | B2 | 9/2005 | Morris et al. | |
| 7,096,673 | B2 | 8/2006 | Little et al. | |
| 7,210,899 | B2 | 5/2007 | Wilson, Jr | |
| 7,347,661 | B2 * | 3/2008 | Phipps et al. | 415/108 |
| 2001/0023581 | A1 | 9/2001 | Ojiro et al. | |
| 2004/0018084 | A1 * | 1/2004 | Halliwell et al. | 415/173.1 |
| 2005/0050901 | A1 | 3/2005 | Little | |
| 2005/0109016 | A1 | 5/2005 | Ullyott | |
| 2005/0129499 | A1 | 6/2005 | Morris et al. | |
| 2005/0238480 | A1 | 10/2005 | Phipps et al. | |
| 2005/0276685 | A1 * | 12/2005 | Wiggins et al. | 415/151 |
| 2007/0003410 | A1 | 1/2007 | Chehab | |
| 2007/0020095 | A1 | 1/2007 | Dierksmeier et al. | |
| 2007/0110564 | A1 | 5/2007 | Leach et al. | |
| 2007/0264120 | A1 * | 11/2007 | Amiot et al. | 415/173.2 |
| 2008/0063509 | A1 * | 3/2008 | Sutherland et al. | 415/14 |

* cited by examiner

TURBINE BLADE TIP CLEARANCE SYSTEM

BACKGROUND OF THE INVENTION

1. Field of the Invention

The invention relates generally to gas turbine engines, and more particularly to controlling the radial clearance between a turbine rotor blade tip and a stator shroud assembly.

2. Description of Related Prior Art

In a turbine engine, combustion gases pass across rotatable turbine blades to convert the energy associated with combustion gases into mechanical motion. A shroud assembly tightly encircles the turbine blades to ensure that combustion gases are forced over the turbine blades and do not pass radially around the turbine blades. It is desirable to maintain the smallest possible gap between the tips of the turbine blades and the shroud assembly to maximize the efficiency of the turbine engine. However, a challenge in maintaining the smallest possible gap arises because the turbine blades can expand radially during various phases of engine operation at a rate that is much greater than a rate at which the shroud assembly can radially expand. For example, when the power output of the turbine engine rapidly increases, such as during take-off in a turbine used for aircraft propulsion, the turbine blades will increase in radial length rapidly and the tips of the turbine blades may penetrate the inner linings of the shroud assembly. This could damage both the turbine blades and the shroud assembly. Also, this event can compromise the capacity of the shroud assembly to maintain the smallest possible gap during periods of relatively low power production.

SUMMARY OF THE INVENTION

In summary, the invention is a system for adjusting a clearance between blade tips of a turbine and a shroud assembly encircling the turbine in a turbine engine. The system includes a first fluid passageway operable to extend from a first source of fluid at a variable pressure, such as some stage of a multi-stage compressor, to a shroud assembly of a turbine engine. The first fluid passageway directs a first stream of fluid to the shroud assembly. The system also includes a first valve positioned along the first fluid passageway. The first valve is moveable between open and closed configurations. The first valve is biased to the open configuration and moved to the closed configuration passively and directly by a first predetermined level of pressure associated with the first stream of fluid. During periods of relatively low power production of the turbine engine, the first valve is in the open configuration and moves to the closed configuration when power production of the turbine engine increases from relatively low power production.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF EXEMPLARY EMBODIMENTS

Figure 1:
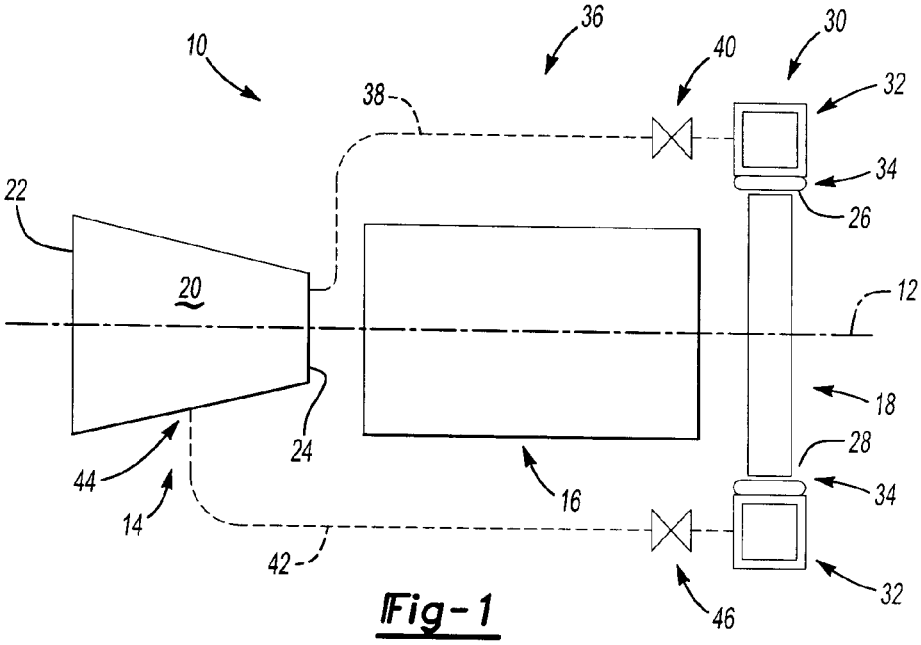
FIG. 1 is a simplified schematic view of a gas turbine engine according to a first exemplary embodiment of the invention.

A plurality of different embodiments of the invention are shown in the Figures of the application. Similar features are shown in the various embodiments of the invention. Similar features have been numbered with a common reference numeral and have been differentiated by all alphabetic suffix. Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or supplement other embodiments unless otherwise indicated by the drawings or this specification.

FIG. 1 is a schematic representation of portions of a turbine engine 10 according to a first exemplary embodiment of the invention. The exemplary turbine engine 10 can have a generally annular configuration. However, it is noted that other configurations can be practiced in alternative embodiments of the present invention. It is also noted that the present invention can be practiced in any operating environment, such as aircraft propulsion, industrial applications including but not limited to pumping sets for gas and oil transmission lines, electricity generation, and naval propulsion.

The turbine engine 10 extends along a centerline axis 12 and can include a compressor section 14, a combustor section 16, and a turbine section 18. The compressor section 14 can include a multi-stage compressor 20 having an inlet 22 and an outlet 24. The turbine section 18 can include a plurality of turbine wheels wherein a plurality of turbine blades extend from each turbine wheel. The turbine section 18 is illustrated schematically in FIG. 1, the turbine wheel and turbine blades being shown as single structure for simplicity. Tips of the turbine blades are referenced at 26 and 28 in FIG. 1. The turbine engine 10 can also include a shroud assembly 30 having a hollow ring member 32 and a plurality of blade tracks 34. The ring member 32 can encircle one or more turbine wheels and support the blade tracks 34 in spaced relation to the turbine blade tips 26, 28.

In operation, combustion gases exit the combustor section 16 and pass across the turbine blades of the turbine section 18 to convert the energy associated with the combustion gases into mechanical motion. The shroud assembly 30 can direct the combustion gases over the turbine blades of the turbine section 18. The ring member 32 can circumferentially expand and contract to move the blade tracks 34 and thereby adjust the clearance between the blade tracks 34 and the tips 26, 28. It can be desirable to move the blade tracks 34 to prevent contact with the turbine blade tips 26, 28 because the radial position of the turbine blade tips 26, 28 relative to the centerline axis 12 changes during operation of the turbine engine 10.

The first exemplary embodiment of the invention provides a system 36 for adjusting the radial clearance between the turbine blade tips 26, 28 and the blade tracks 34 of the shroud assembly 30. The system 36 includes a first fluid passageway 38 operable to extend between a source of fluid at a variable pressure to the shroud assembly 30. In the exemplary embodiment of the invention, the source of fluid at variable pressure can be the outlet 24 of the compressor 20. In alternative embodiments of the invention, the source of fluid at variable pressure can be any stage of the compressor 20. The first fluid passageway 38 can extend from the outlet 24 to an interior of the ring member 32. The first fluid passageway 38 is shown schematically in FIG. 1, however, in practice, can be any configuration of conduit, tubing, or piping.

The pressure of the fluid exiting the compressor 20 varies as the power production of the turbine engine 10 varies. For example, when the turbine engine 10 is producing power at a relatively high rate, the pressure of the fluid exiting the outlet 24 will be relatively high. Conversely, when the turbine engine 10 is producing power at a relatively low rate, the pressure of the fluid exiting the outlet 24 will be relatively low.

For a turbine used for aircraft propulsion, as one example, "relatively low power production" occurs just prior to take-off and when the aircraft reaches cruising speed. Power production increases from relatively lower power production rapidly during take-off. Power production may also increase from relatively low power production in response to other conditions.

The fluid exiting the outlet 24 and directed through the first fluid passageway 38 to the interior of the ring member 32 can be relatively hot, even during periods of low power production. Thus, a first stream of fluid directed through the first fluid passageway 38 can heat the ring member 32. Through heating, the ring member 32 can circumferentially expand and move the blade tracks 34 radially outward.

The system 36 can also include a first valve 40 positioned along the first fluid passageway 38. The first valve 40 can be moveable between open and closed configurations and can be biased to the open configuration. The first valve 40 can move to the closed configuration passively and directly in response to a first predetermined level of pressure of the first stream of fluid. As set forth above, when the turbine engine 10 is producing power at a relatively low rate the pressure of the fluid exiting the outlet 24 will be relatively low. The first valve 40 can overcome the pressure of the fluid during periods of relatively low power production and remain in the open configuration. When the turbine engine 10 increases power production from the relatively low rate, the pressure of the fluid exiting the outlet 24 will increase. The first valve 40 can move to the closed configuration passively and directly in response to this increase in fluid pressure. The first valve 40 is shown schematically in FIG. 1. In practice, the first valve 40 can be any configuration of valve, including but not limited to a poppet valve.

The system 36 can also include a second fluid passageway 42 operable to extend between a second source of fluid at a variable pressure to the shroud assembly 30. In the exemplary embodiment of the invention, the second source of fluid at variable pressure can be the an inter-stage portion of the compressor 20. The pressure of the fluid exiting a bleed opening 44 off the inter-stage portion of the compressor 20 varies as the power production of the turbine engine 10 varies. For example, when the turbine engine 10 is producing power at a relatively high rate, the pressure of the fluid exiting the bleed opening 44 will be relatively high. Conversely, when the turbine engine 10 is producing power at a relatively low rate, the pressure of the fluid exiting the bleed 44 will be relatively low. The second fluid passageway 38 can extend from the bleed opening 44 to the interior of the ring member 32. The second fluid passageway 38 is shown schematically in FIG. 1, however, in practice, can be any configuration of conduit, tubing, or piping.

The system 36 can also include a second valve 46 positioned along the second fluid passageway 42. The second valve 46 can be moveable between open and closed configurations and can be biased to the closed configuration. The second valve 46 can move to the open configuration passively and directly by a second predetermined level of pressure of the second stream of fluid. As set forth above, when the turbine engine 10 is producing power at a relatively low rate the pressure of the fluid exiting the bleed opening 44 will be relatively low. The second valve 46 can overcome the pressure of the fluid during periods of relatively low power production and remain in the closed configuration. When the turbine engine 10 increases power production from the relatively low rate, the pressure of the fluid exiting the bleed opening 44 will increase. The second valve 46 can move to the open configuration passively and directly in response to this increase in fluid pressure. The second valve 46 is shown schematically in FIG. 1, however, in practice, can be any configuration of valve, including a poppet valve.

When the second valve 46 is open, the fluid exiting the bleed opening 44 and directed through the second fluid passageway 42 to the interior of the ring member 32 can be relatively cool, even during periods of high power production. Thus, a second stream of fluid directed through the second fluid passageway 42 can cool the ring member 32. Through cooling, the ring member 32 can circumferentially contract and move the blade tracks 34 radially inward. In the first exemplary embodiment of the invention, the temperature of the first stream of fluid exiting the compressor section 20 at low power can be higher than the temperature of the second stream of fluid exiting the bleed opening 44 at high power.

The system 36 can be configured such that the first and second valves 40, 46 act cooperatively. For example, the first and second valves 40, 46 can be designed such that the first valve 40 closes at substantially the same time as the second valve 46 opens. In such an embodiment, when the turbine engine 10 is operating at a relatively low rate of power production, the first valve 40 can be open and relatively hot fluid from the outlet 24 can be received in the interior of the ring member 32. During this period, the relatively cool fluid is not being received from the bleed opening 44 since the fluid is at a relatively low pressure, a level of pressure insufficient to overcome the second valve 46. As a result, the ring member 32 can be heated and circumferentially expanded.

The operation of the turbine engine 10 can then change and power production can be increased. The increased power production will result in the respective pressures of the fluids exiting the outlet 24 and exiting the bleed opening 44 increasing. With respect to the fluid at the outlet 24, the increase in pressure can passively and directly cause the first valve 40 to close and thereby terminate the flow of the first stream of relatively hot fluid to the interior of the ring member 32. With respect to the fluid at the bleed opening 44, the increase in pressure can passively and directly cause the second valve 46 to open and thereby initiate the flow of the second stream of relatively cool fluid to the interior of the ring member 32. As a result, the ring member 32 can be cooled and circumferentially contracted. The first and second valves 40, 46 can be designed such that the second valve 46 opens substantially at the same time as the first valve 40 closes.

It is noted that at any level of power production of the turbine engine 10, the pressure of fluid exiting the outlet 24 will be greater than the pressure of fluid exiting the bleed opening 44. Generally, the pressure at any stage of the compressor 20 will be greater than the pressure at any other upstream stage of the compressor at any particular level of power production. In the exemplary embodiment, the first stream of fluid is directed from the outlet 24 of the compressor 20, however, the first stream of fluid can be drawn from an different, upstream stage of the compressor 20 in alternative embodiments of the invention. In such an embodiment, the second stream of fluid can be drawn from a stage of the compressor 20 upstream of the stage from which the first stream is drawn.

Figure 2:
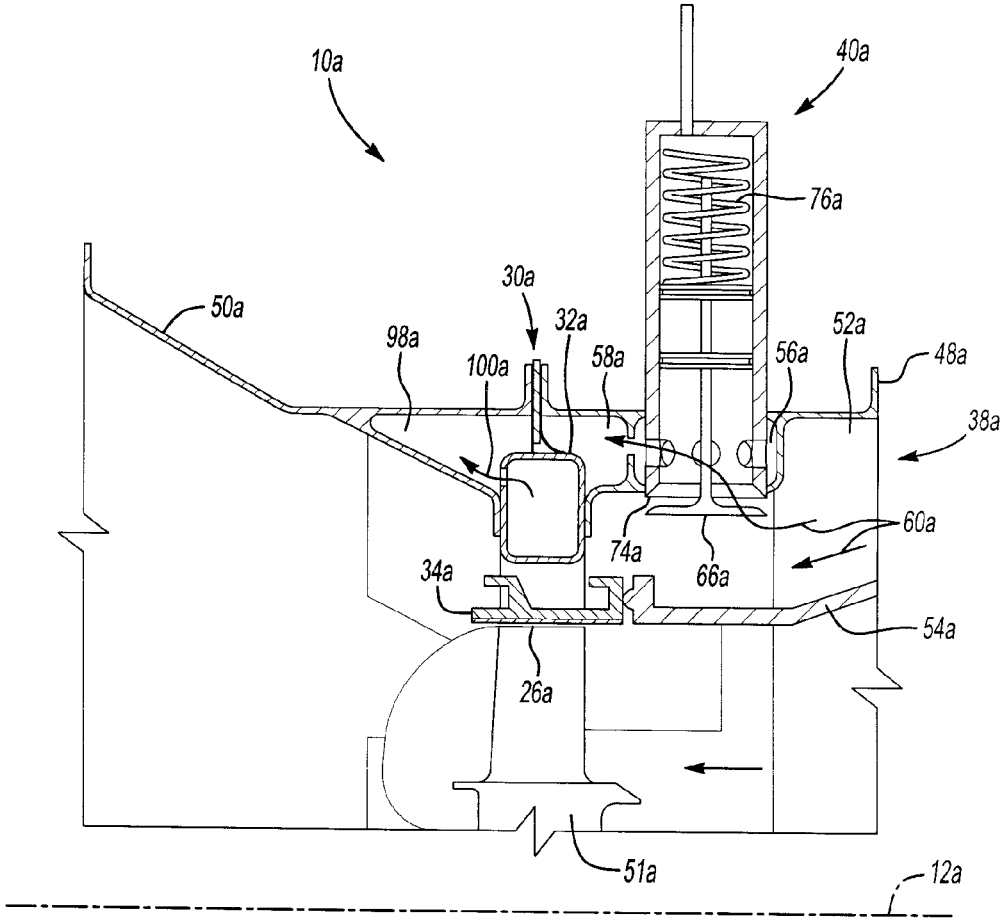
FIG. 2 is a first cross-sectional view take along a centerline axis of a second exemplary embodiment of the invention.

FIG. 1 is a schematic representation of a turbine engine 10 according to the first exemplary embodiment of the invention. FIGS. 2-6 are detailed views showing structures of a second exemplary embodiment of the invention. FIG. 2 shows a portion of a turbine engine 10*a*, omitting compressor and combustor sections to focus on a shroud assembly 30*a*. The turbine 10*a* can be centered on an axis 12*a* and have a forward housing member 48*a* and an aft housing member 50*a* connected together to enclose a turbine blade 51*a* of a turbine section and the shroud assembly 30*a*. The shroud assembly 30*a* can include a ring member 32*a* and a plurality of blade tracks 34*a*.

FIG. 2 also shows a portion of a first fluid passageway 38*a* for directing a first stream of fluid from a source of fluid at variable pressure to the shroud assembly 30*a*. In the second exemplary embodiment of the invention, the source of fluid can be an outlet of a compressor (not shown). The exemplary passageway 38*a* can include a first portion 52*a* defined between the forward housing member 48*a* and an interior enclosure 54*a*. The exemplary passageway 38*a* can also include a second portion 56*a* downstream of the first portion 52*a* and defined by the forward housing member 48*a*. The exemplary passageway 38*a* can also include a third portion 58*a* downstream of the second portion 56*a* and defined between the forward housing member 48*a* and the ring member 32*a*. The first stream of fluid can pass through the first fluid passageway 38*a* as well as the ring member 32*a* and is represented by arrows 60*a*.

Figure 3:
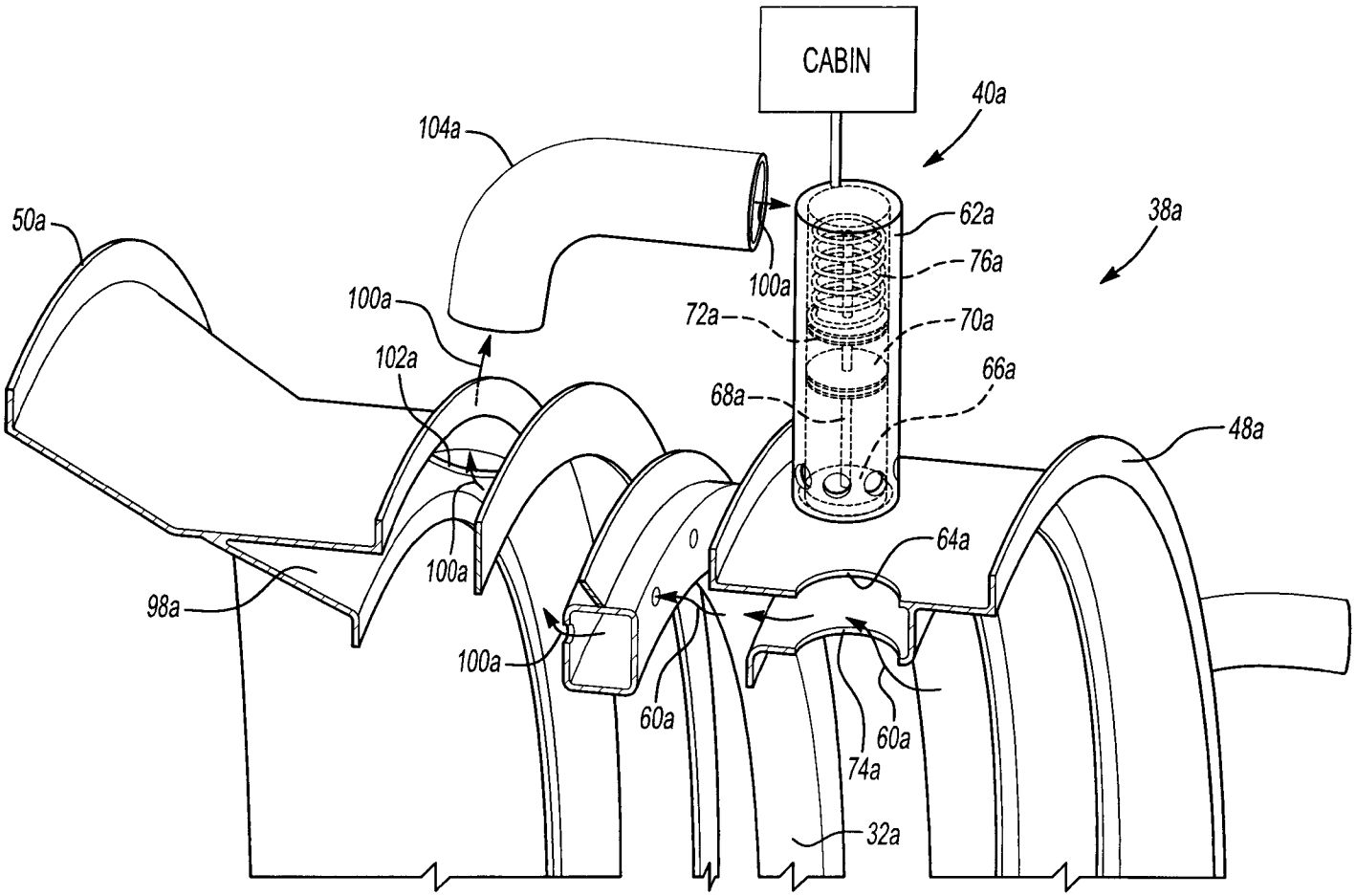
FIG. 3 is an exploded view corresponding to the planar view of FIG. 2.

FIG. 2 also shows an exemplary first valve 40*a*. The first valve 40*a* can be a poppet valve. FIG. 3 shows that the first valve 40*a* can include a casing 62*a* that can bear threads for mating with corresponding threads of an aperture 64*a* defined by the forward housing member 48*a*. The first valve 40*a* can also include a head 66*a*, a stem 68*a*, a sealing member 70*a*, and a disk 72*a* fixed together and movable within the casing 62*a*. When the first valve 40*a* is in the open configuration, the head 66*a* can be spaced from a valve seat 74*a* defined by either the casing 62*a* or the forward housing member 48*a*. When the first valve 40*a* is in the closed configuration, the head 66*a* can be seated on the valve seat 74*a*. A spring 76*a* can act directly against the disk 72*a* to bias the head 66*a* away from the valve seat 74*a*. The spring 76*a* can be disposed in an interior portion of the casing 62*a* that communicates with cabin air pressure, isolated from the first fluid passageway 38*a* by the sealing member 70*a* to prevent the temperature of the first stream of fluid from changing the operating characteristics of the spring 76*a*. Both of the sealing member 70*a* and the disk 72*a* can receive inner o-rings for sealing against the casing 62*a*.

As shown in FIG. 2, the first valve 40*a* can be biased to the open configuration. With reference to FIG. 3, the pressure of the first stream of fluid passing through the first fluid passageway 38*a* can act upon the sealing member 70*a*. As the pressure of the first stream of fluid increases, the force urging the sealing member 70*a* against the force of the spring 74*a* increases. At some predetermined level of pressure, the sealing member 70*a* can move against the force of the spring 76*a* until the head 66*a* seats on the valve seat 74*a*, closing the valve 40*a* and terminating the first stream of fluid.

Figure 4:
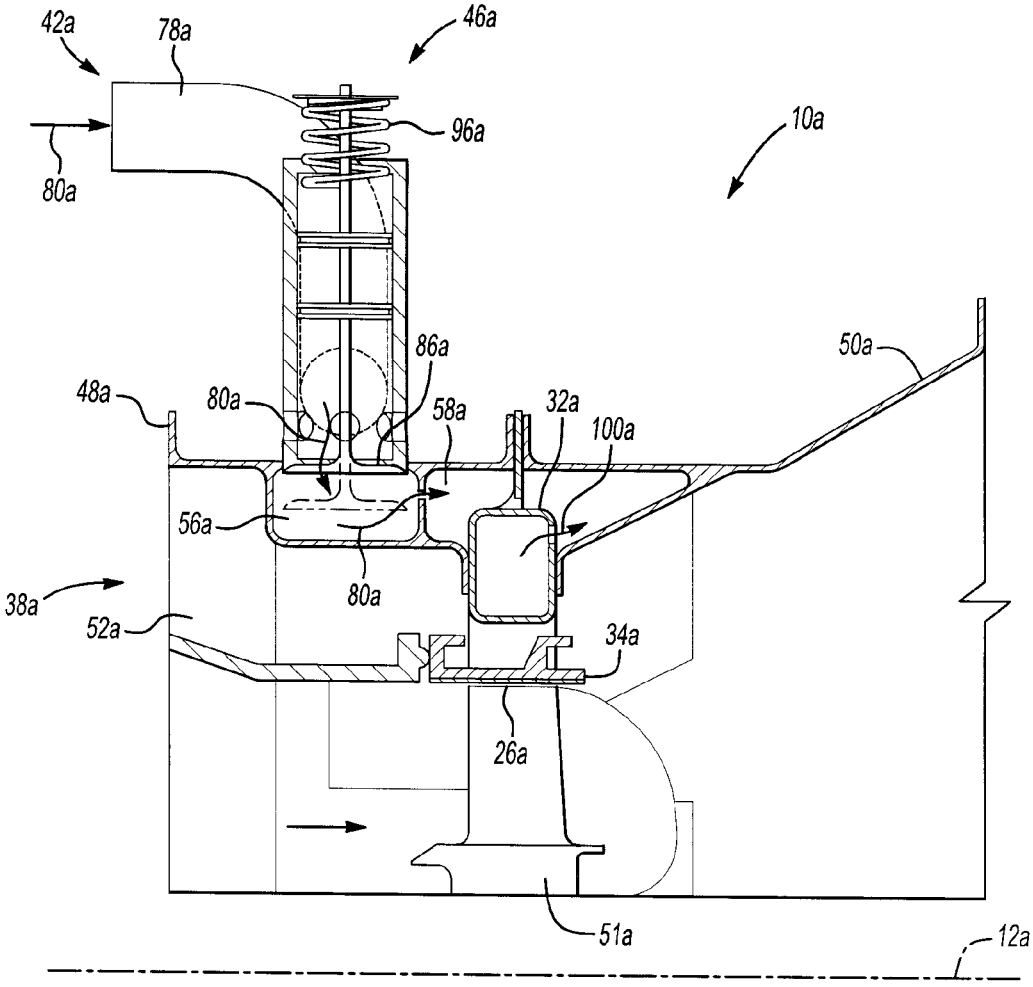
FIG. 4 is a second cross-sectional view take along the centerline axis of the second exemplary embodiment of the invention, taken from an opposite perspective relative to the view of FIG. 2.

FIG. 4 is a second cross-sectional view of the second exemplary embodiment of the invention taken along the centerline axis 12*a*. FIG. 4 is taken from a perspective of view that is opposite to the perspective of view taken for FIG. 2. In other words, FIG. 4 can be viewed as centerline cross-section taken from a "right" side of the turbine engine 10*a* and FIG. 2 can be viewed as centerline cross-section taken from a "left" side of the turbine engine 10*a*. The designations of "right" and "left" are arbitrary and only used to designate opposite sides.

As shown in FIG. 4, the second exemplary embodiment of the invention includes a second fluid passageway 42*a* for directing a second stream of fluid from a source of fluid at variable pressure to the shroud assembly 30*a*. In the second exemplary embodiment of the invention, the second source of fluid at variable pressure can be an inter-stage bleed opening from a compressor (not shown). The exemplary passageway 42*a* can include a first portion 78*a* defined by conduit extending along an exterior of the forward housing member 48*a*. The exemplary passageway 42*a* can also include the second portion 56*a*, which is downstream of the first portion 78*a* and defined by the forward housing member 48*a*. The exemplary passageway 42*a* can also include the third portion 58*a*, which is downstream of the second portion 56*a* and defined between the forward housing member 48*a* and the ring member 32*a*. Thus, the second and third portions 56*a* and 58*a* are shared by the first and second fluid passageways 38*a*, 42*a*. As a result, the first and second fluid passageways 38*a*, 42*a* can partially extend parallel to one another and partially common to one another, the portions 52*a* and 78*a* being in parallel and the portions 56*a* and 58*a* representing an a common or shared length of passageway. The second stream of fluid can pass through the second fluid passageway 42*a* as well as the ring member 32*a* and is represented by arrows 80*a*.

Figure 5:
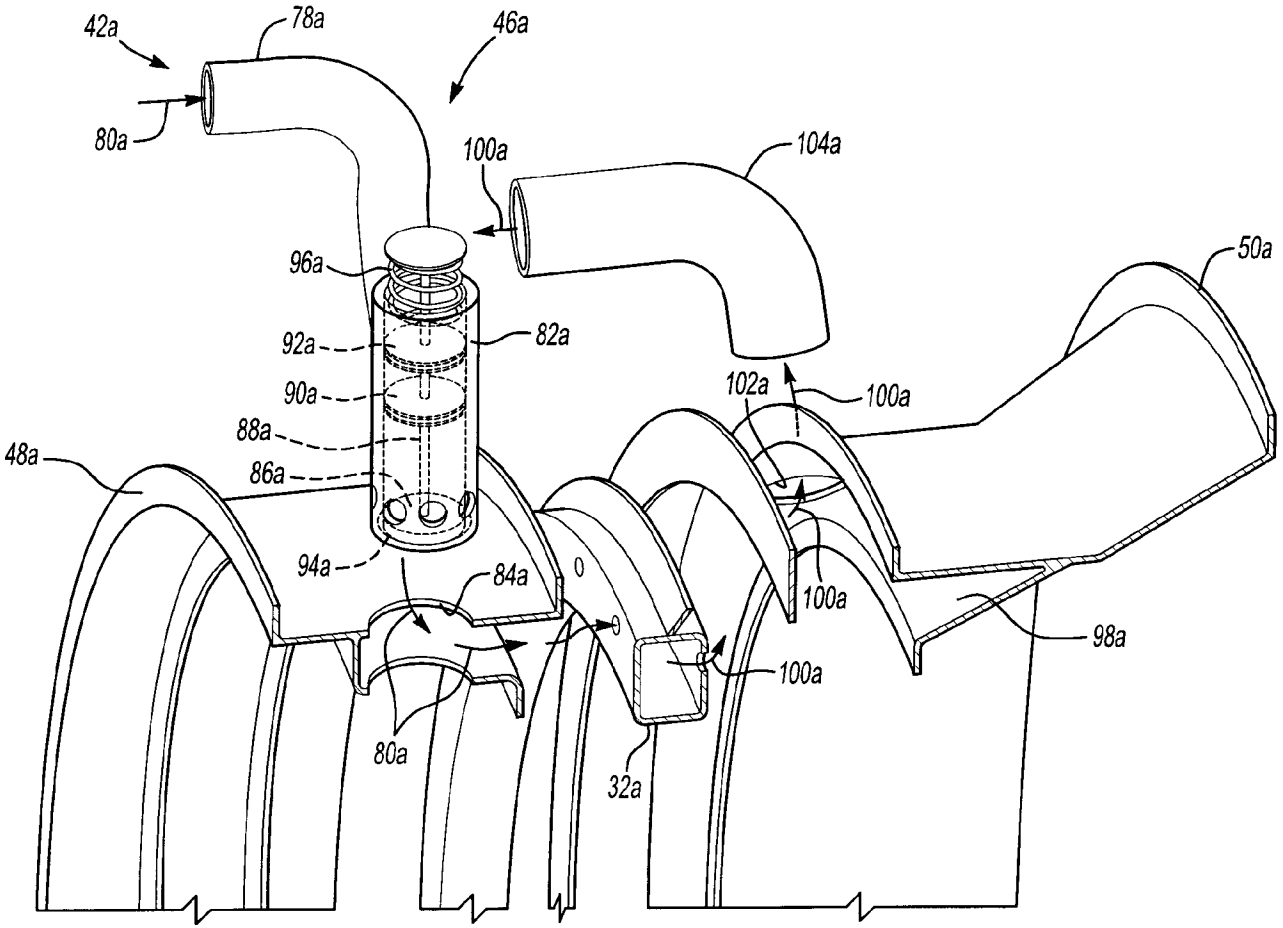
FIG. 5 is an exploded view corresponding to the planar view of FIG. 4.

FIG. 4 also shows a second valve 46*a*. The second valve 46*a* can be a poppet valve. FIG. 5 shows that the second valve 46*a* can include a casing 82*a* that can bear threads for mating with corresponding threads of an aperture 84*a* defined by the forward housing member 48*a*. The second valve 46*a* can also include a head 86*a*, a stem 88*a*, a sealing member 90*a*, and a disk 92*a* fixed together and movable within the casing 82*a*. When the second valve 46*a* is in the open configuration, the head 86*a* can be spaced from a valve seat 94*a* defined by either the casing 82*a* or the forward housing member 48*a*. When the second valve 46*a* is in the closed configuration, the head 86*a* can be seated on the valve seat 94*a*. A spring 96*a* can act directly upon the disk 92*a* to bias the head 86*a* toward the valve seat 94*a*, "pulling" the head 86*a* against the valve seat 94*a*. The spring 96*a* can be disposed in an interior portion of the casing 82*a* that communicates with cabin air pressure, isolated from the second fluid passageway 42*a* by the sealing member 90*a* to prevent the temperature of the second stream of fluid from changing the operating characteristics of the spring 96*a*. The sealing member 90*a* and disk 92*a* can receive an o-ring for sealing against the stem 88*a*.

As shown in FIG. 4, the second valve 46*a* can be biased to the closed position. The pressure of the second stream of fluid passing through the second fluid passageway 42*a* acts upon the back of the head 86*a*. As the pressure of the second stream of fluid increases, the force urging the head 86*a* to unseat from the valve seat 94*a* increases. At some predetermined level of pressure, the head 86*a* can be urged to move against the force of the spring 96*a* and can unseat from the valve seat 94*a*, opening the valve 46*a* and initiating the second stream of fluid.

As with the first embodiment of the invention, the first and second valves 40*a*, 46*a*, shown in FIGS. 2 and 4 respectively, can be designed to act cooperatively. For example, the first and second valves 40*a*, 46*a* can be designed such that the first valve 40*a* closes at substantially the same time as the second valve 46*a* opens. In such an embodiment, when the turbine engine 10*a* is operating at a relatively low rate of power production, the first valve 40*a* can be open and relatively hot fluid can be received in the interior of the ring member 32*a*. During this period, the relatively cool fluid is not being received since second valve 46*a* is closed. As a result, the ring member 32*a* can be heated and circumferentially expanded during period of relatively low power production and the gap between a tip 26*a* of the turbine blade 51*a* and the blade tracks 34*a* can be maximized. When the operation of the turbine engine 10 increases from relatively low power production, the resulting increases in the respective fluid pressures of the first and second fluid streams can cause the first valve 40*a* to close and the second valve 46*a* to open. During this period, the relatively cool fluid can be received in the ring member 32*a* and the ring member 32*a* can therefore be cooled and circumferentially contracted, reducing the size of the gap between the tip 26*a* of the turbine blade 51*a* and the blade tracks 34*a*.

At any level of power production of the turbine engine 10*a*, the fluid pressure associated with the first fluid stream can be greater than the fluid pressure associated with the second fluid stream. Therefore, the predetermined level of fluid pressure that will cause the first valve 40*a* shown in FIG. 2 to close can be greater than the predetermined level of fluid pressure that will cause the second valve 46*a* shown in FIG. 4 to open, if the first and second valves 40*a*, 46*a* are designed to act cooperatively as described above.

It is noted that the first and second valves 40*a*, 46*a* can be designed such that the respective predetermined levels of pressure are achieved substantially immediately upon acceleration of the turbine engine 10*a*. In other words, embodiments of the invention can be practiced wherein the first valve 40*a* is open and the second valve 46*a* is closed only at the lowest rate of power production or engine speed. In such embodiments, the valves 40*a*, 46*a* can be designed such that the first valve 40*a* closes and the second valve 46*a* opens substantially immediately upon any acceleration of the turbine engine 10*a* from idle. However, it also noted that the invention is not limited to such embodiments. The first and second valves 40*a*, 46*a* can be tuned differently in alternative embodiments of the invention.

FIGS. 2 and 4 show that in the second exemplary embodiment of the invention, both of the first and second fluid streams act on the first and second valves 40*a*, 46*a*. As set forth above, the first fluid stream acts directly on the sealing member 70*a* of the first valve 40*a* to close the first valve 40*a*. The Figures also show that the first fluid stream acts on the second valve 46*a* as well. For example, the first fluid stream passes through the second portion 56*a*. The front of the head 86*a* of the second valve 46*a* faces the interior of the second portion 56*a*; therefore, the fluid pressure associated with the first stream cooperates with the spring 96*a* in urging the second valve 46*a* closed. The spring rate of the spring 96*a* can be selected in view of the pressure of the first stream of fluid acting on the front of the head 86*a*. When the first valve 40*a* is closed, the fluid pressure associated with the first stream ceases to act on the head 86*a* of the second valve 46*a*.

The second fluid stream also passes through the second portion 56*a*. The back of the head 66*a* of the first valve 40*a* faces the interior of the second portion 56*a*; therefore, the fluid pressure associated with the second stream cooperates with the spring 76*a* in urging the first valve 40*a* open. The spring rate of the spring 76*a* can be selected in view of the pressure of the second stream of fluid acting on the back of the head 66*a* such that the first valve 40 will not open unless desired.

FIGS. 3 and 5 show that exhaust fluid can exit the ring member 32*a* and enter a chamber 98*a* defined by the aft housing member 50*a*. The exhaust fluid is represented by arrows 100*a*. The exhaust fluid can be returned to the source of pressurized fluid, such as the inlet of a compressor, to the cabin for an aircraft application, or to cool some other component. The exhaust fluid can pass through an aperture 102*a* in the aft housing member 50*a* and into a conduit 104*a* to reach a desired location.

Figure 6:
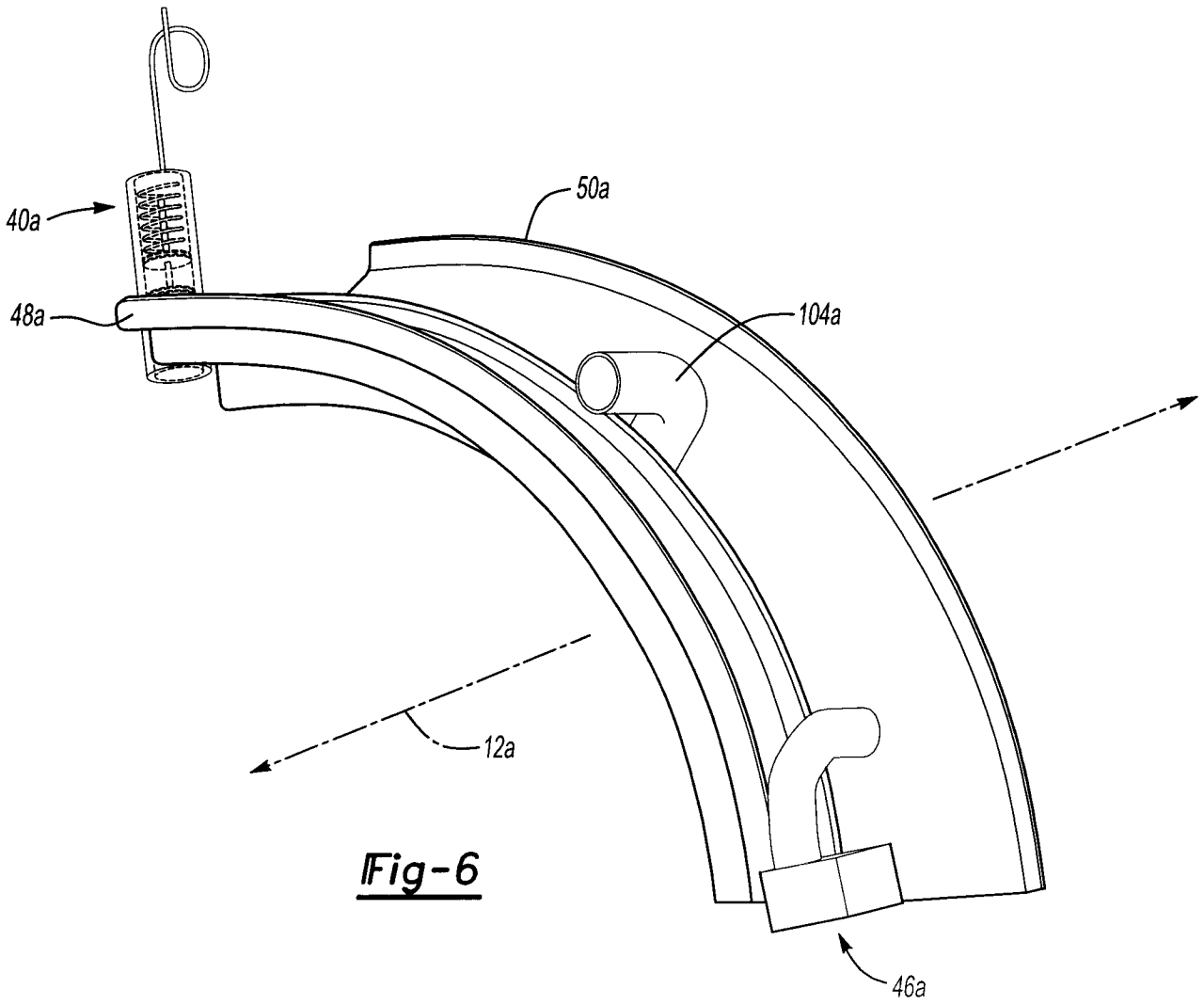
FIG. 6 is a perspective view of a portion of the second exemplary embodiment of the invention showing the positions of fluid passageways relative to one another.

FIG. 6 is a partial perspective view of the second exemplary embodiment of the invention to show an exemplary arrangement of the first and second valves 40*a*, 46*a* relative to one another. FIG. 6 only shows about one-quarter of the forward and aft housing members 48*a*, 50*a* and only one first valve 40*a* and one second valve 46*a*. However, the forward and aft housing members 48*a*, 50*a* can fully encircle the centerline axis 12*a* and the valves 40*a*, 46*a* can be positioned along the circle in alternating relation. As a result, the second embodiment can include a plurality of first fluid passageways 38*a* (shown in FIGS. 2 and 3) and a plurality of second fluid passageways 42*a* (shown in FIGS. 2 and 3). Conduits 104*a* for exhaust fluid can be positioned between one of the first valves 40*a* and one of the second valves 46*a*.

Figure 7:
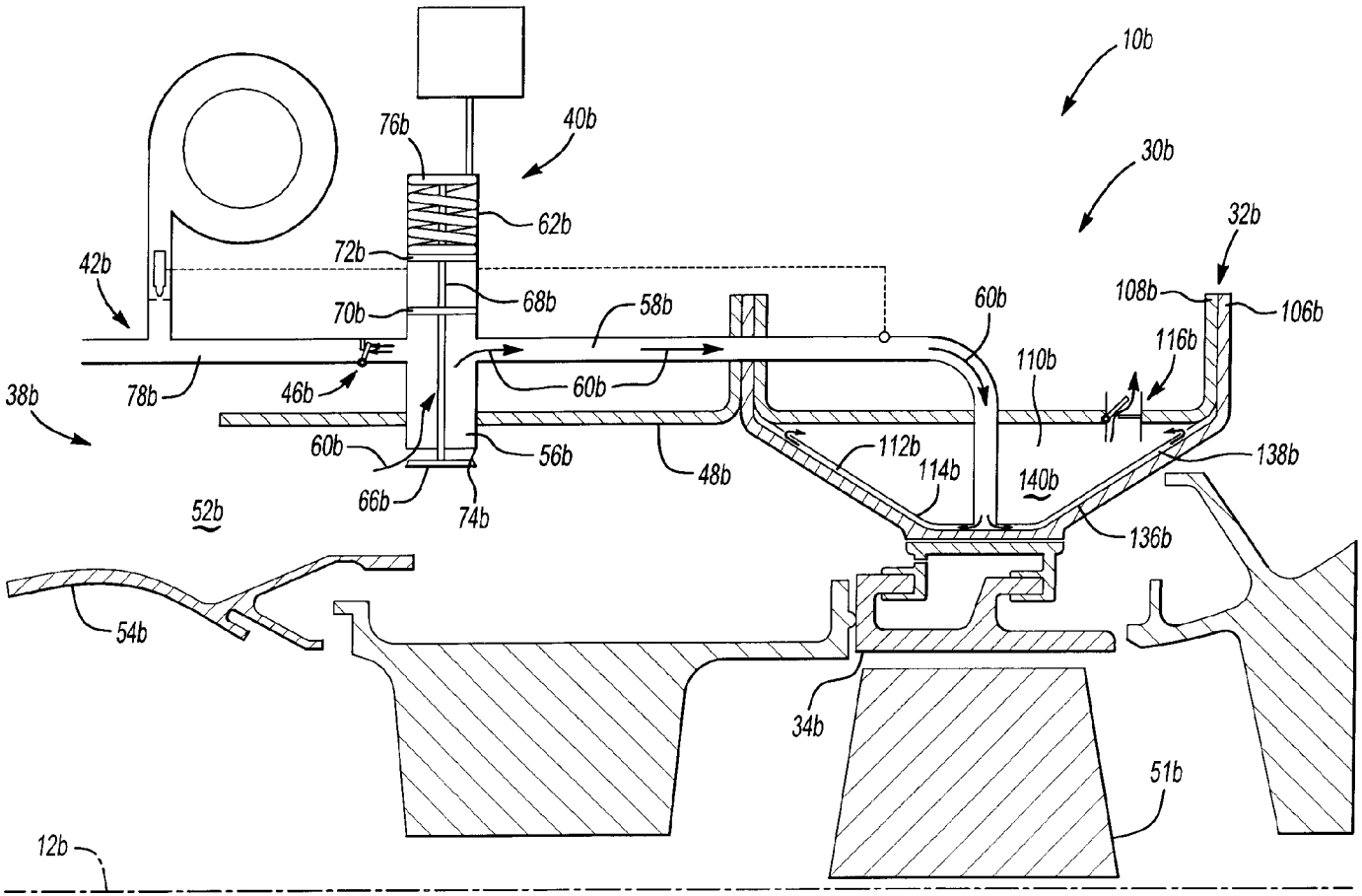
FIG. 7 is a first schematic cross-sectional view of a third exemplary embodiment of the invention.

FIG. 7 is a schematic illustration of a third exemplary embodiment of the invention, showing a portion of a turbine engine 10*b* without showing compressor or combustor sections. The turbine engine 10*b* can extend along a centerline 12*b* and can include a forward housing member 48*b* and a shroud assembly 30*b* disposed along the axis 12*b*. The shroud assembly 30*b* can include ring member 32*b* and a plurality of blade tracks 34*b*. The ring member 32*b* can include an inner member 106*b* and an outer member 108*b*. The inner and outer members 106*b*, 108*b* can be engaged together to define an annular cavity 110*b*. The blade track 34*b* can be spaced radially outward of a turbine blade 51*b* of the turbine engine 10*b*.

A first fluid passageway 38*b* can extend between a source of fluid at a variable pressure to the cavity 110*b*. The exemplary passageway 38*b* can include a first portion 52*b* defined between the forward housing member 48*b* and an interior enclosure 54*b*. The exemplary passageway 38*b* can also include a second portion 56*b* downstream of the first portion 52*b*. The second portion 56*b* can be defined by a first valve 40*b* (to be described in greater detail below). The exemplary passageway 38*b* can also include a third portion 58*b* downstream of the second portion 56*b*. The exemplary third portion 58*b* can be a conduit or tubing. The exemplary passageway 38*b* can also include a fourth portion 112*b* downstream of the third portion 58*b*. The fourth portion 112*b* can communicate directly with the cavity 110*b*. Fluid can exit the chamber 110*b* through a one-way check valve 116*b*. The first stream of fluid is represented by the arrows 60*b*.

The fourth portion 112*b* can be defined between the inner member 106*b* and a plate 114*b* (illustrated schematically as a single line) The plate 114*b* can be shaped to correspond to the shape of the inner member 106*b* and be spaced relatively close to the inner member 106*b*. The plate 114*b* can be disposed adjacent to a radially innermost surface 136*b* in the cavity 110*b*. The plate 114*b* can bifurcate the cavity 110*b* into a first portion 138*b* defined between the plate 114*b* and the surface 136*b* and a second portion 140*b*. The second portion 140*b* of the cavity 110*b* can be larger than the first portion 138*b* and can be positioned radially outward of the first portion 138*b*. The first fluid passageway 38*b* can direct fluid to the first portion 138*b* to maximize heat transfer between the first stream of fluid and the innermost surface 136*b*. The plate 114*b* can focus the flow of fluid to the surface 136*b*, rather than being dispersed generally in the cavity 110*b*. As a result, the heat transfer between the fluid and the inner member 106*b* can be enhanced.

The first valve 40*b* can be a poppet valve having a casing 62*b*, a head 66*b*, a stem 68*b*, a sealing member 70*b*, and a disk 72*b*. The interior of the casing 62*b* can define the second portion 56*b* of the fluid passageway 38*a*. The head 66*b*, stem 68*b*, sealing member 70*b* and disk 72*b* can be fixed together and movable within the casing 62*b*. When the first valve 40*b* is in the open configuration, the head 66*b* can be spaced from a valve seat 74*b* defined by either the casing 62*b* or the forward housing member 48*b*. When the first valve 40*b* is in the closed configuration, the head 66*b* can be seated on the valve seat 74*b*. A spring 76*b* can act directly against the disk 72*b* to bias the head 66*b* away from the valve seat 74*b*. The spring 76*b* can be disposed in an interior portion of the casing 62*b* that communicates with cabin air pressure, isolated from the first fluid passageway 38*b* by the sealing member 70*b* to prevent the temperature of the first stream of fluid from changing the operating characteristics of the spring 76*b*. The sealing member 70*b* can be fixed in the casing 62*b* and receive an o-ring for sealing against the stem 68*b*.

The third exemplary embodiment can also includes a second fluid passageway 42*b* and a second valve 46*b* positioned along the second fluid passageway 42*b*. The second fluid passageway 42*b* can include a first portion 78*b*, as well as the second, third and fourth portions 56*b*, 58*b*, 112*b*. The exemplary second valve 46*b* can be a one-way check valve. As shown in FIG. 7, the fluid pressure in the first stream of fluid can force the second valve 46*b* closed.

Figure 8:
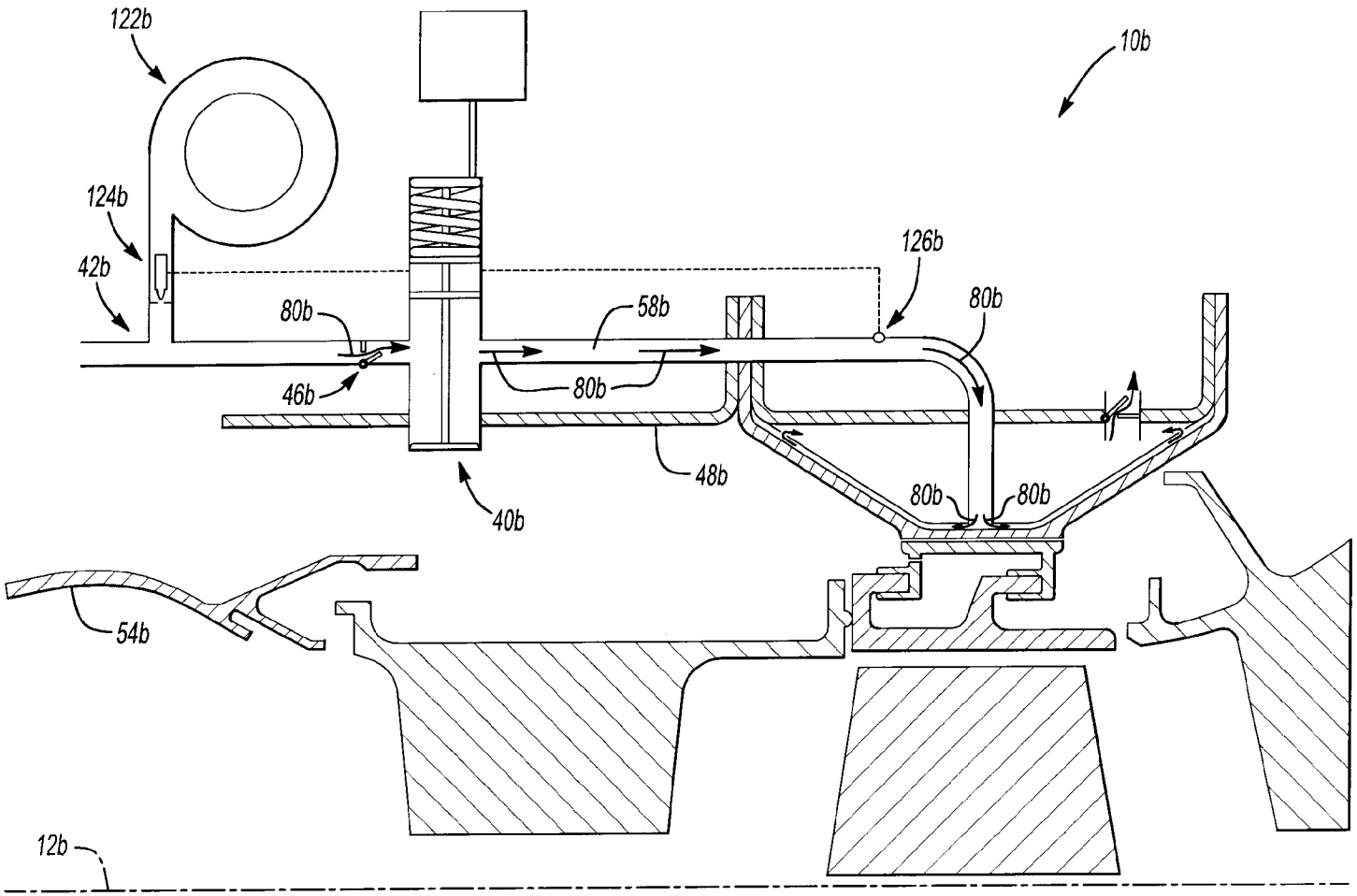
FIG. 8 is a second schematic cross-sectional view of the third exemplary embodiment.

In FIG. 7, the third exemplary embodiment is shown when power production of the turbine engine 10*b* is relatively low, such as during idle. The first valve 40*b* can be open and the second valve 46*b* can be closed. The first stream of fluid represented by arrows 60*b* can pass through first fluid passageway 38*b* to the heat and circumferentially expand the inner member 106*b*, moving the blade tracks 34*b* radially outward. FIG. 8 shows the third embodiment of the invention when power production of the turbine engine 10*b* increases from a relatively low rate. The first valve 40*b* can be closed and the second valve 46*b* can be open. The second stream of fluid can pass through second fluid passageway 42*b* to the cool and circumferentially contract the inner member 106*b*, moving the blade tracks 34*b* radially inward. The second stream of fluid is represented by the arrows 80*b*.

The third exemplary embodiment of the invention also includes a feature not disclosed in the first and second embodiments. As shown in FIG. 8, the turbine engine 10*a* can include a supplemental cooling system having a pump 122*b*. The pump 122*b* can direct fluid at a predetermined temperature to join the second stream of fluid, thereby by decreasing the temperature of the second stream of fluid. This feature can be desirable if the temperature of the second stream of fluid at high power is not as cool as desired. The supplemental cooling system can also include a valve 124*b* moveable between open and closed positions, a sensor (represented by a point 126*b*) having a thermocouple or some other structure for identifying temperature change and a controller 125*b*. The controller 125*b* can be integral with the valve 124*b*, the sensor, or be separate from both the valve 124*b* and the sensor. The sensor can emit a signal to the controller 125*b* corresponding to a temperature in the third portion 58*b*. The controller 125*b* can receive and interpret the signal from the sensor and determine the temperature in the third portion 58*b*. In response to the determine signal, and in accordance with programmed logic, the controller 125*b* can control the valve 124*b* to moved to the open position.

The programmed logic can be carried out such that if the temperature in the third portion 58*c* is greater than a predetermined value, the controller 125*b* can cause the valve 124*b* to open, allowing relatively cool fluid to mix with the second stream of fluid. During periods when the turbine engine 10*b* is producing relatively low power, the warmer first stream of fluid can be passed by the sensor, causing the valve 124*b* to move to the open configuration. However, strength of the pump 122*b* can be selected such that the combined fluid pressure of the second stream of fluid and the fluid from the pump 122*b* will not urge the valve 46*b* open during periods when the turbine engine 10*b* is producing relatively low power. Alternatively, the logic of the controller 125*b* can be programmed such that the controller 125*b* is operable to recognize low power operation based on the temperature in the third portion 58*c*. In other words, the controller 125*b* can be operable to recognize that when the temperature in the third portion 58*c* is higher than some predetermined value, the turbine engine is producing power at a relatively low rate and it would not be necessary to direct supplemental cooling fluid to the second fluid passageway 42*b*.

Figure 9:
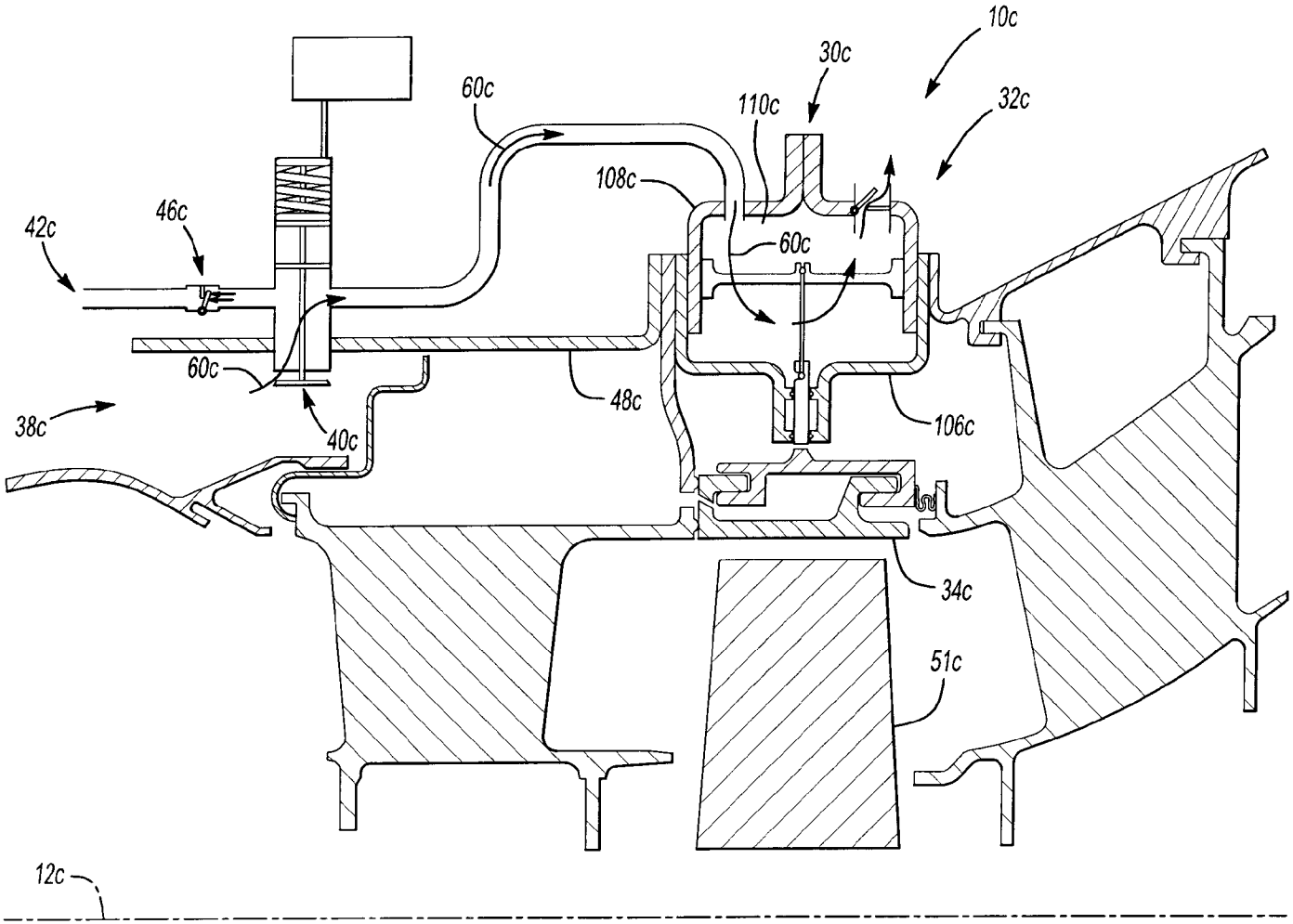
FIG. 9 is a first schematic cross-sectional view of a fourth exemplary embodiment of the invention.

FIG. 9 is a schematic illustration of a fourth exemplary embodiment of the invention. A portion of a turbine engine 10*c* is shown extending along a centerline 12*c*. The turbine engine 10*c* can include a forward housing member 48*c* and a shroud assembly 30*c* disposed along the axis 12*c*. The shroud assembly 30*c* can include ring member 32*c* and a plurality of blade tracks 34*c*. The ring member 32*b* can include an inner member 106*c* and an outer member 108*c*. The inner and outer members 106*c*, 108*c* can be engaged together to define an annular cavity 110*c*. The blade track 34*c* can be spaced radially outward of a turbine blade 51 c of the turbine engine 10*c*.

A first fluid passageway 38*c* can extend between a source of fluid at a variable pressure and the cavity 110*c*. A first valve 40*c* can be positioned along the first fluid passageway 38*c*. A second fluid passageway 42*c* can extend between a second source of fluid at a variable pressure and the cavity 110*c*. A second valve 46*c* can be positioned along the second fluid passageway 42*c*. The operation of the valves 40*c*, 46*c* is generally similar to the operation of the valves of the third exemplary embodiment.

Figure 10:
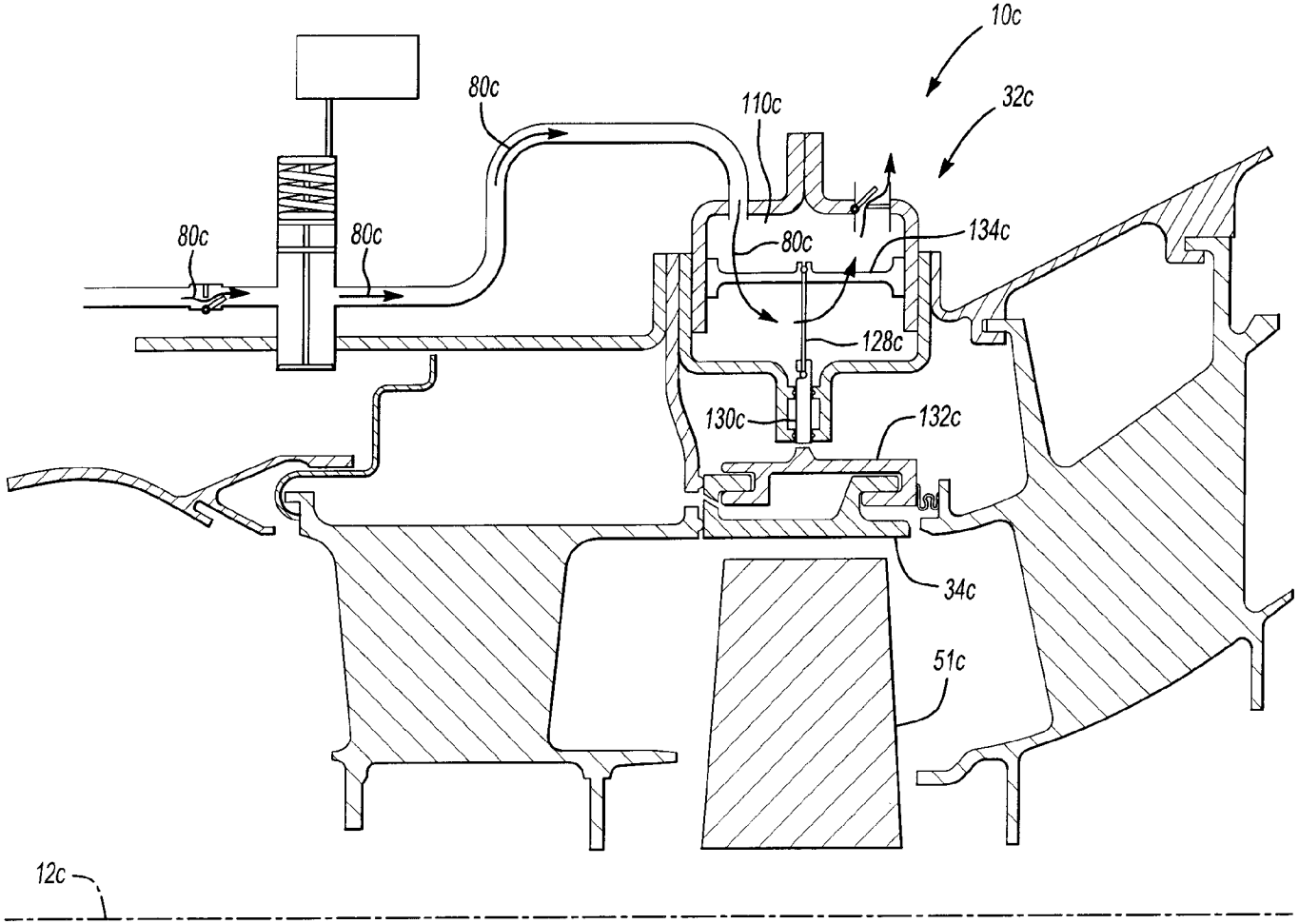
FIG. 10 is a second schematic cross-sectional view of the fourth exemplary embodiment.

Referring now to FIG. 10, the fourth exemplary embodiment of the invention also includes a feature not disclosed in the first, second or third embodiments. Radial movement of the blade tracks 34*c* can be accomplished with rods 128*c* disposed in the cavity 110*c*. The exemplary rod 128*c* can be connected to the blade tracks 34*c* through a linkage, such as exemplary links 130*c* and 132*c*. FIG. 10 is a schematic cross-section, showing the connection between the rod 128*c* and single blade track 34*c*. A plurality of individual rods 128*c* can extend 360 degrees around the axis 12*c* and similar or different linkages can connect each rod 128*c* to each blade track 34*c* disposed around the axis 12*c*.

The rods 128*c* are coupled to a sleeve member 134*c*. The sleeve member 134*c* can extend fully around the axis 12*c* in the fourth exemplary embodiment of the invention, but could extend only partially around the axis is alternative embodiments of the invention. The sleeve member 134*c* can be heated by the first stream of fluid (represented by arrows 60*c* in FIG. 9) and circumferentially expand, pulling the blade tracks 34*c* radially outward through the linkage defined by the rod 128*c* and the links 130*c* and 132*c*. In addition, sleeve member 134*c* can be cooled by the second stream of fluid represented by arrows 80*c* and circumferentially contract, pushing the blade tracks 34*c* radially inward through the linkage defined by the rod 128*c* and the links 130*c* and 132*c*. The sleeve member 134*c* can define a plurality of apertures for allowing the passage of heating or cooling fluid around the sleeve member 134*c* and for increasing the area for heat transfer.

The expansion and contraction of the sleeve member 134*c* can be guided by the outer member 108*c*. For example, the sleeve member 134*c* can be cross-keyed with the outer member 108*c* such that the sleeve member 134*c* can move radially relative to the outer member 108*c* and be prevented from rotating relative to the outer member 108*c*. At a radially inner periphery, the link 130*c* can be guided in motion by the ring member 32*c* or some other structure. Guiding movement of the sleeve member 134*c* and other portions of the linkage between the sleeve member 134*c* and the blade track 34*c* can ensure that expansion and contraction of the sleeve member 134*c* is effectively transmitted to motion of the blade tracks 34*c*.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A system for adjusting a clearance between blade tips of a turbine and a shroud assembly in a turbine engine, the system comprising:

a first fluid passageway in fluid communication with a first source of fluid at a first pressure from a first compressor stage of a multi-stage compressor and extending between the first compressor stage and a shroud assembly of a turbine engine to direct a first stream of fluid at the first pressure to the shroud assembly;

a second fluid passageway in fluid communication with a second source of fluid at a second pressure from a second compressor stage of the multi-stage compressor and extending between the second compressor stage and the shroud assembly to direct a second stream of fluid at the second pressure to the shroud assembly;

a first valve positioned along said first fluid passageway and a second valve positioned along said second fluid passageway, each of said first and second valves moveable between open and closed configurations, said first valve controlled passively and directly by the first pressure of the first stream of fluid, said second valve controlled passively and directly by the second pressure of the second stream of fluid;

wherein said first and second fluid passageways are in fluid communication with an interior region of said shroud assembly to direct said first and second streams of fluid into said interior region, said first and second fluid streams flow through said interior region of said shroud assembly to thermally expand and contract said shroud assembly to adjust the clearance between the blade tips and the shroud assembly; and wherein said first valve is moved toward said closed configuration when power production of the turbine engine is increased from a period of relatively low power production and/or wherein said second valve is moved toward said open configuration when power production of the turbine engine is increased from a period of relatively low power production.

2. The system of claim 1 wherein said first valve is further defined as a poppet valve.

3. The system of claim 2 wherein said first valve is further defined as being biased to said open configuration by a spring isolated from the first stream of fluid.

4. The system of claim 1 wherein said second valve is further defined as being biased to said closed configuration.

5. The system of claim 1 wherein said second valve is further defined as a one-way check valve urged to said closed configuration by the first stream of fluid.

6. The system of claim 1 wherein said first and second fluid passageways are further defined as partially parallel to one another and partially common to one another.

7. The system of claim 1 wherein said second fluid passageway is further defined as being operable to extend between a bleed opening at an inter-stage portion of the multi-stage compressor and the shroud assembly of the turbine engine.

8. The system of claim 1 wherein said interior region of said shroud assembly comprises an annular chamber that is defined by a ring attached to a blade track; and wherein the clearance is defined between the blade tips and the blade track.

9. The system of claim 1 wherein the second pressure from the second compressor stage is lower than the first pressure from the first compressor stage.

10. The system of claim 1 wherein the first stream of fluid from the first compressor stage is at a first temperature and the second stream of fluid from the second compressor stage is at a second temperature different from the first temperature.

11. The system of claim 1 wherein said first valve biased toward said open configuration and moved toward said closed configuration passively and directly by the first pressure of the first stream of fluid; and wherein said second valve biased toward said closed configuration and moved toward said open configuration passively and directly by the second pressure of the second stream of fluid.

12. A method for adjusting a clearance between blade tips of turbine and a shroud assembly spaced radially outward of the blade tips and comprising the steps of:

heating a shroud assembly of a turbine engine with a first stream of fluid directed along a first fluid passageway from an outlet of a compressor section of the turbine engine, the first fluid passageway extending to the shroud assembly;

closing the first fluid passageway to stop said heating step with a first valve positioned along the first fluid passageway, wherein said closing step occurs passively and directly in response to a first predetermined level of pressure of the first stream of fluid;

wherein the first fluid passageway extends to and is in fluid communication with an interior region of the shroud assembly to direct the first stream of fluid into the interior region, the first fluid stream flows through the interior region of the shroud assembly to thermally expand and contract the shroud assembly to adjust the clearance between the blade tips and the shroud assembly; and wherein said closing step is further defined as occurring when power production of the turbine engine increases from a period of relatively low power production.

13. The method of claim 12 wherein said heating step is further defined as occurring only during periods of relatively low power production of the turbine engine.

14. The method of claim 12 further comprising the steps of:

opening a second fluid passageway to direct a second stream of fluid to the shroud assembly from an inter-stage portion of the compressor section to cool the shroud assembly.

15. The method of claim 14 wherein said opening step and said closing step are further defined as being concurrent with one another.

16. The method of claim 14 wherein said opening step is further defined as:

opening the second fluid passageway passively and directly in response to a second predetermined level of pressure of the second stream of fluid.

17. The method of claim 14 wherein said opening step is further defined as:

opening the second fluid passageway passively and directly in response to a pressure differential between the first and second streams of fluid.

18. The method of claim 14 further comprising the steps of:

closing the second fluid passageway with a second valve; and forming the first fluid passageway and the second passageway to be common with one another downstream of the first and second valves to prevent both of the first and second streams of fluid from flowing concurrently to the shroud assembly.

19. The method of claim 12 wherein the interior region of the shroud assembly comprises an annular chamber that is defined by a ring attached to a blade track; and wherein the clearance is defined between the blade tips and the blade track.

20. A method for adjusting a clearance between blade tips of turbine and a shroud assembly spaced radially outward of the blade tips and comprising the steps of:

heating a shroud assembly of a turbine engine with a first stream of fluid directed along a first fluid passageway from an outlet of a compressor section of the turbine engine, the first fluid passageway extending to the shroud assembly;

closing the first fluid passageway to stop said heating step with a first valve positioned along the first fluid passageway, wherein said closing step occurs passively and directly in response to a first predetermined level of pressure of the first stream of fluid;

wherein the first fluid passageway extends to and is in fluid communication with an interior region of the shroud assembly to direct the first stream of fluid into the interior region, the first fluid stream flows through the interior region of the shroud assembly to thermally expand and contract the shroud assembly to adjust the clearance between the blade tips and the shroud assembly;

opening a second fluid passageway to direct a second stream of fluid to the shroud assembly from an inter-stage portion of the compressor section to cool the shroud assembly; and wherein said opening step is further defined as occurring only when power production of the turbine engine increases from relatively low power production.

21. The method of claim 20 wherein said opening step and said closing step are further defined as being concurrent with one another.

22. The method of claim 20 wherein said opening step is further defined as:

opening the second fluid passageway passively and directly in response to a second predetermined level of pressure of the second stream of fluid.

23. The method of claim 20 wherein said opening step is further defined as:

opening the second fluid passageway passively and directly in response to a pressure differential between the first and second streams of fluid.

24. The method of claim 20 further comprising the steps of:

closing the second fluid passageway with a second valve; and forming the first fluid passageway and the second passageway to be common with one another downstream of the first and second valves to prevent both of the first and second streams of fluid from flowing concurrently to the shroud assembly.

25. A turbine engine comprising:

a multi-stage compressor section;

a turbine section having a plurality of turbine blades spaced from said multi-stage compressor section along a centerline axis;

a shroud assembly supporting a plurality of blade tracks in radially spaced relation to said turbine blades and defining an annular chamber encircling an axis;

a first fluid passageway in fluid communication with an outlet of said multi-stage compressor section and extending to said annular chamber of said shroud assembly to direct a first stream of fluid to said shroud assembly;

a first valve positioned along said first fluid passageway and moveable between open and closed configurations, said first valve being biased to said open configuration and moved to said closed configuration passively and directly by a first predetermined level of pressure of the first stream of fluid;

a second fluid passageway in fluid communication with an inter-stage portion of said multi-stage compressor section and extending to said annular chamber to direct a second stream of fluid to said annular chamber;

a second valve positioned along said second fluid passageway and moveable between open and closed configurations, said second valve moved to said open configuration passively and directly by a second predetermined level of pressure of the second stream of fluid;

wherein said first fluid passageway extends to and is in fluid communication with said annular chamber of said shroud assembly to direct said first stream of fluid into said annular chamber, said first fluid stream flows through said annular chamber of said shroud assembly to thermally expand and contract said shroud assembly to adjust the clearance between the blade tips and the blade tracks; and wherein said first and second valves are positioned in circumferentially-spaced relation to one another about said centerline axis.

26. The turbine engine of claim 25 wherein said annular chamber of said shroud assembly is defined by a ring attached to said blade tracks; and wherein the clearance is defined between the blade tips and the blade tracks.

27. A turbine engine comprising:

a multi-stage compressor section;

a turbine section having a plurality of turbine blades spaced from said multi-stage compressor section along a centerline axis;

a shroud assembly supporting a plurality of blade tracks in radially spaced relation to said turbine blades and defining an annular chamber encircling an axis;

a first fluid passageway in fluid communication with an outlet of said multi-stage compressor section and extending to said annular chamber of said shroud assembly to direct a first stream of fluid to said shroud assembly;

a first valve positioned along said first fluid passageway and moveable between open and closed configurations, said first valve being biased to said open configuration and moved to said closed configuration passively and directly by a first predetermined level of pressure of the first stream of fluid;

a second fluid passageway in fluid communication with an inter-stage portion of said multi-stage compressor section and extending to said annular chamber to direct a second stream of fluid to said annular chamber;

a second valve positioned along said second fluid passageway and moveable between open and closed configurations, said second valve moved to said open configuration passively and directly by a second predetermined level of pressure of the second stream of fluid;

a supplemental cooling system communicating with said second fluid passageway to cool the second fluid stream by directing additional fluid to the second fluid stream; and wherein said first fluid passageway extends to and is in fluid communication with said annular chamber of said shroud assembly to direct said first stream of fluid into said annular chamber, said first fluid stream flows through said annular chamber of said shroud assembly to thermally expand and contract said shroud assembly to adjust the clearance between the blade tips and the blade tracks.

28. The turbine engine of claim 27 wherein said first and second valves are positioned in circumferentially-spaced relation to one another about said centerline axis.

29. The turbine engine of claim 27 wherein said supplemental cooling system includes:

a pump;

a third valve positioned between said pump and said second fluid passageway and moveable between open and closed configurations to selectively direct the additional fluid to the second fluid stream;

a sensor positioned along said second fluid passageway and operable to communicate a signal corresponding to a temperature in said second fluid passageway; and a controller operable to receive the signal from said sensor and control said third valve to move to one of the open and closed configurations.

* * * * *